United States Patent [19]

Hatterer et al.

[11] 4,049,443

[45] Sept. 20, 1977

[54] METHOD OF FABRICATION OF AN ALLOY CONTAINING AN ALKALI METAL AND/OR AN ALKALINE-EARTH METAL

[75] Inventors: Andre Hatterer, Riedisheim; Claude Oberlin, Avon; Pierre Strobel, Mulhouse, all of France

[73] Assignee: Commissariat a l'Energie Atomique, Paris, France

[21] Appl. No.: 647,858

[22] Filed: Jan. 9, 1976

Related U.S. Application Data

[63] Continuation of Ser. No. 487,540, July 11, 1974, abandoned.

[30] Foreign Application Priority Data

July 31, 1973 France ..... 73.28045

[51] Int. Cl.[2] ..... C22B 26/10

[52] U.S. Cl. ..... 75/66; 75/67 R; 75/135

[58] Field of Search ..... 75/135, 66, 134 A, 67, 75/10 A

[56] References Cited

U.S. PATENT DOCUMENTS

| | | | |
|---|---|---|---|
| 1,797,131 | 3/1931 | DeBoer | 75/66 |
| 2,132,408 | 10/1938 | Gardner | 75/67 |

*Primary Examiner*—Peter D. Rosenberg
*Attorney, Agent, or Firm*—Ernest F. Marmorek

[57] ABSTRACT

The method consists in subjecting a mixture of an alkali nitride and/or an alkaline-earth nitride to thermal decomposition in vacuo in the presence of at least one metallic component with which it is desired to alloy the alkali metal and/or the alkaline-earth metal, the metals thus brought together are melted and the alloy thus obtained is homogenized.

17 Claims, 3 Drawing Figures

Figure 1:
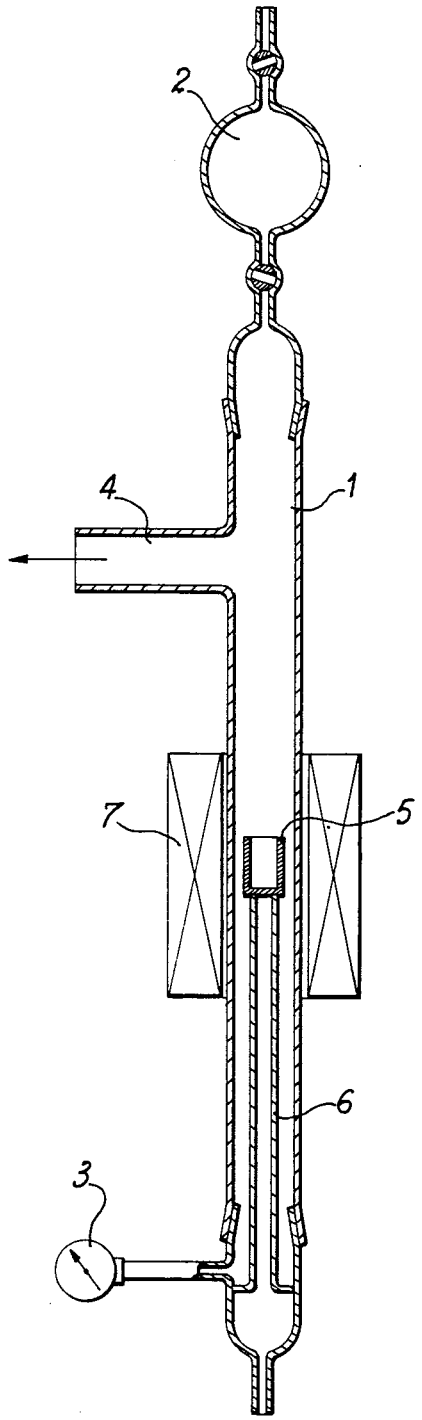

METHOD OF FABRICATION OF AN ALLOY CONTAINING AN ALKALI METAL AND/OR AN ALKALINE-EARTH METAL

This is a continuation, of application Ser. No. 487,540, filed July 11, 1974, and now abandoned.

This invention relates to a method of fabrication of an alloy containing an alkali metal and/or an alkaline-earth metal, and includes thermionic diodes and multi-element spectrum lamps containing said alloy.

The conventional methods of fabrication of alloys from metals of commercially available types which are introduced in the desired proportions and then homogenized at high temperature often give rise to sampling problems, especially in the case of metals as reactive as an alkali metal such as caesium and in the case of the alkaline-earth metals.

From this it follows, for example, that the sampling of strontium in a laboratory entails the need for the design and development of a strontium drawing-frame for delivering wire which is calibrated and cut in a vacuum. Sampling of an alkali metal such as caesium also creates a number of problems although its transfer in a vacuum is facilitated by its low melting point. In both cases, the obtainment of predetermined proportions is not an easy matter since it proves necessary to perform difficult handling operations such as weighing in glove boxes. Moreover, the various operations call for a large number of metal-glass contacts which are all potential causes of contamination of samples.

The method in accordance with the inventon overcomes the disadvantages recalled in the foregoing, especially insofar as it permits the production of alkalis and alkaline-earths in metallic form without resulting in excessively violent reactions and permits the use of alkalis and/or alkaline-earths in order to form alloys with other metals having different characteristics without any attendant danger.

The method according to the invention is characterized in that a mixture of an alkali nitride and/or an alkaline-earth nitride is subjected to thermal decomposition in vacuo in the presnce of at least one metallic component with which it is desired to alloy the alkali metal and/or the alkaline-earth metal, the metals thus brought together are melted and the alloy thus obtained is homogenized.

In other words, the present invention is a method of producing an alloy containing an alkali-metal, an alkali-earth metal and a metal alloyable therewith, which comprises confining at least one alkali-metal nitride, at least one alkali- earth metal nitride and at least one metallic co-component of the alloy to be formed in a reaction chamber, thermally decomposing substantially in a vacuum the alkali metal and alkali- earth metal nitrides in said chamber to a mixture of alkali-metal and alkali- earth metals, and melting the mixture of metals thereby forming a substantially homogeneous alloy.

The method under cnsideration makes it possible to prepare, for example :

either a binary alloy of an alkaline-earth metal such as strontium or barium with a metallic component such as aluminum, gallium, indium, gold, tin, silicon;

or a ternary alloy of an akali metal such as caesium and an alkaline-earth metal such as strontium or barium with a metallic component such as gold, tin, silicon;

or a quaternary alloy of an alkali metal such as caesium and an alkaline-earth metal such as strontium or barium with two metallic components such as aluminum gallium, indium, tin, gold, silicon.

The list given above is clearly not intended to set any limitation on the scope of the invention.

The method in accordance with the invention is of particular interest in the fabrication of alloys having a base of caesium and strontium or alloys having a base of caesium and barium, especially the Cs-Sr-Al-Sn alloys or the Cs-Ba-Al-Sn alloys. In point of fact, these alloys were fairly difficult to obtain up to the present time and their use is particularly advantageous in thermionic conversion. In fact, thermionic diodes require the presence between the emitter and the collector of a caesium plasma which regulates the work function of the emitter by adsorption and ensures utilization of the space charge by becoming ionized. Substantial improvements (reduction of the work function and of the voltage drop within the interelectrode space) result from the use of a binary plasma consisting of caesium + strontium or caesium + barium (the so-called two-alkali diodes). The construction of diodes of this type can be highly simplified if the vapors of caesium and strontium or barium emanate from a single reservoir containing an alloy which is capable of liberating suitable vapor pressures of caesium and of strontium or of barium. Since caesium and strontium are very sparingly soluble in each other, it is necessary for the thermionic application to have recourse to ternary or quaternary alloys of these metals such as Cs-Sr-Al-Sn alloy of the Cs-Ba-Al-Sn alloy.

The alloys having a base of caesium and strontium or barium which are fabricated in accordance with the invention can also be employed in the construction of cathodes of multi-element spectrum lamps. They may also be employed as getters of gases such as oxygen and water vapor.

By virtue of the method according to the invention in which the alkali nitride and the alkaline-earth nitride are subjected to thermal decomposition in the presence of metallic components with which it is desired to alloy said alkali metal and said alkaline-earth metal, the fabrication of these alloys does not give rise to any problem. In fact, caesium nitride $CsN_3$ decomposes at about 500° C ; strontium nitride $Sr(N_2)_2$ decomposes abruptly at about 140° C and barium nitride $Ba(N_2)_2$ decomposes at 153° C. When a mixture of caesium nitride and strontium or barium nitride is heated in accordance with the invention, it is immediately observed after the expected decomposition of the alkaline-earth nitrides that incipient distillation of the caesium takes place. Thus caesium nitride which is relatively stable in the pure state is totally decomposed in the presence of alkaline-earth nitride in the vicinity of the temperature of decomposition of this latter. Moreover, the proportions of caesium and strontium or barium in the metallic mixture obtained are identical with those of the initial mixture of nitrides. This reaction is therefore of considerable interest in the preparation of caesium and strontium alloys or caesium and barium alloys since it makes it possible to avoid the complications of separate sampling of components in metallic form.

In accordance with one advantageous feature of the method contemplated by the invention, a nitrogen getter such as titanium or zirconium is added to the metals while melting is in progress or alternativey said nitrogen getter is added to the alloy after said alloy has been formed. This makes it possible to prevent the formation of nitrides in the alloy which is obtained.

A clearer understanding of the invention will be gained from the following description of a few non-limitative examples of application of the method under consideration. Examples 1 and 2 relate to the fabrication of a binary alloy having a base of strontium or barium and Example 3 relates to the fabrication of a ternary or quaternary alloy having a base of caesium and strontium or barium.

EXAMPLE 1

Strontium or barium nitride is subjected to vacuum decomposition within a tube formed of the metal which it is desired to alloy with strontium or with barium. After stemming, the tube containing the strontium or the barium which results from decomposition can be transported in air into the homogenization chamber. The complete assembly is then re-evacuated, then heated in order to permit homogenization.

This mode of operation makes it possible to obtain an alloy containing a substantial excess quantity of metal with respect to the strontium or the barium.

EXAMPLE 2

It is sought to prepare an alloy Sr-Al (or Sr-Ga or Sr-In). This fabrication process is performed in the device shown in the accompanying FIG. 1. The device employed comprises a tube 1 of quartz and of Vycor glass above which is mounted an argon reservoir 2, a pressure gauge 3 being connected to the base of the tube ; a vacuum can be created by means of a connection at 4. The alumina crucible 5 in which the formation of the alloy takes place is mounted on a support 6 which is also of alumina. That portion of the tube 1 in which the crucible 5 is placed is surrounded by a furnace 7.

The fabrication of the alloy is carried into effect as follows : the strontium nitride and the metal with which it is desired to form an alloy are placed in the crucible 5 in the form of a powder or an ingot. The strontium nitride is decomposed in vacuum at 140° C, then heated in argon (at a pressure in the vicinity of 300 torr) at 1000° C for a period of two hours.

An alloy having a low strontium content is thus obtained.

EXAMPLE 3

There is placed within a steel crucible a mixture of caesium nitride and strontium or barium nitride in the desired proportions, in the presence of the metal or metals with which they are to be alloyed. In order to prevent distillation of the caesium which is much more volatile than the other constituents, homogenization is performed within a closed chamber. This homogenization in a closed chamber may be carried out in either of the two devices shown in the accompanying FIGS. 2 and 3.

Figure 2:
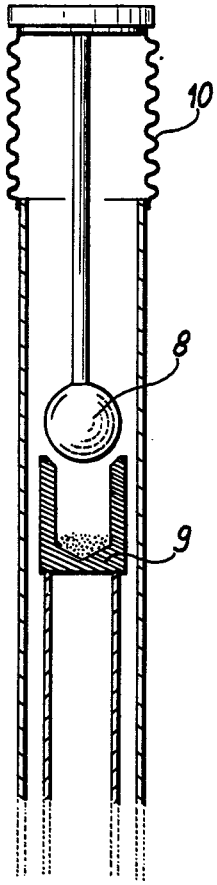

FIG. 2 illustrates a homogenization device comprising a ball-type plug. Leak-tightness is ensured by means of a stainless steel ball 8 applied against the ground surface of the opening of the crucible 9 which contains the alloy as a result of compression of a bellows element 10. After homogenization, the ball is withdrawn by expansion of the bellows element 10.

Figure 3:
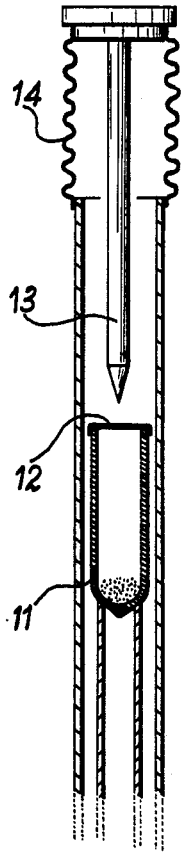

FIG. 3 illustrates a homogenization device of the sealed ampoule type. The crucible 11 which contains the alloy is constituted by a stainless steel tube, the top end wall 12 of which has a small thickness, said tube being stemmed and sealed after introduction of the constituents and decomposition of the nitrides. After homogenization, opening of the tube is performed in vacuum by perforating the top end wall 12 of the crucible 11 by means of a cone-point punch 13 which is operated by compression of a metallic bellows element 14.

What we claim is:

1. A method of producing an alloy containing an alkali metal, an alkali-earth metal and a metal co-component alloyable thereiwth, comprising:

confining at least one alkali metal nitride, at least one alkali-earth metal nitride and at least one metallic co-component of the alloy to be formed in a reaction chamber;

thermally decomposing, substantially in a vacuum, said alkali metal nitride and said alkali-earth metal nitride in said chamber to a mixture of said alkali and alkali-earth metals, and melting said mixture of metals thereby forming a substantially homogeneous alloy.

2. A method according to claim 1, wherein a nitrogen getter selected from the group consisting of titanium and zirconium is added to the metals during the melting process.

3. A method according to claim 1, wherein a nitrogen getter selected from the group consisting of titanium and zirconium is added to the alloy after said alloy has been formed.

4. A method as claimed in claim 1 wherein said alloy is a ternary alloy of an alkali metal consisting of caesium and of an alkali-earth metal selected from the group consisting of strontium and barium, with a metallic component selected from the group consisting of tin, gold and silicon.

5. A method as claimed in claim 1 wherein said alloy is a quaternary alloy of an alkali metal consisting of caesium and of an alkali-earth metal selected from the group consisting of strontium and barium, with two metallic components selected from the group consisting of aluminum, gallium, indium, tin, gold and silicon.

6. The method as defined in claim 1 wherein said melting is carried out at about 1000° C.

7. The method as defined in claim 1 wherein said melting is carried out for about two hours.

8. The method as defined in claim 1 wherein said decomposition is carried out at about 140° C.

9. A thermionic diode containing an alloy produced by the method as defined in claim 4.

10. A multi-element spectrum lamp containing an alloy produced by the method of claim 4.

11. A multi-element spectrum lamp containing an alloy produced by the method of claim 5.

12. A getter adapted to trap oxygen and water vapors containing an alloy produced by the method of claim 4.

13. A getter adapted to trap oxygen and water vapors containing an alloy produced by the method of claim 5.

14. A method of producing an alloy containing at least one metal selected from the group consisting of alkali metals and alkali-earth metals, and an additonal metal co-component;

confining at least one nitride selected from the group consisting of alkali metal nitrides and alkali-earth metal nitrides in a reaction chamber with the additional metal co-component alloyable with said metals; and thermally decomposing in a vacuum, said nitride to its component metal and nitrogen; and melting the resultant mixture of metals thereby forming a substantially homogeneous alloy.

15. A method, as claimed in claim 14 wherein said metal co-component and the said nitride are both in a granular form and are mixed together before the thermal decomposing step.

16. A method, as claimed in claim 14 wherein the melting step is carried out with argon filling the reaction chamber.

17. A method, as claimed in claim 14, wherein the inner wall of the reaction chamber is composed of said metallic co-component.

* * * * *